United States Patent [19]

Tomlinson

[11] Patent Number: 4,739,746

[45] Date of Patent: Apr. 26, 1988

[54] HEAT EXCHANGER FOR FURNACE

[75] Inventor: Ronald S. Tomlinson, Mount Juliet, Tenn.

[73] Assignee: Heil-Quaker Home Systems, Inc., Lavergne, Tenn.

[21] Appl. No.: 922,398

[22] Filed: Oct. 23, 1986

[51] Int. Cl.[4] ..... F24H 3/08

[52] U.S. Cl. ..... 126/110 R; 126/116 R; 237/53

[58] Field of Search ..... 237/50, 55, 53; 126/99 R, 110 R, 116 R, 110 B; 165/146, 147

[56] References Cited

U.S. PATENT DOCUMENTS

| | | | |
|---|---|---|---|
| 1,965,102 | 7/1934 | Jerome | 257/166 |
| 2,276,400 | 3/1942 | Hubbard | 237/55 |
| 2,391,028 | 12/1945 | Miles | 126/99 |
| 2,715,399 | 8/1955 | Witt et al. | 126/110 |
| 3,661,140 | 5/1972 | Raleigh | 126/90 |
| 4,256,082 | 3/1981 | Scholten et al. | 126/110 AA |
| 4,298,061 | 11/1981 | Hoeffken | 165/170 |
| 4,467,780 | 8/1984 | Ripka | 126/110 R |

*Primary Examiner*—Henry A. Bennet

*Attorney, Agent, or Firm*—Jeffers, Hoffman & Niewyk

[57] ABSTRACT

Heat transfer structure for transferring heat from products of combustion to air to be conditioned in a furnace. The heat transfer structure includes an inlet portion receiving hot products of combustion from a burner and extending generally transversely to the direction of the flow of air to be conditioned by heat transfer association therewith. The heat transfer structure further includes at least three successive legs extending generally parallel to the direction of air flow. In one form, the transverse leg is disposed at the inlet portion of the air flow passages, and in a modified form, the transverse leg is disposed remotely therefrom. In the illustrated embodiments, the air moving structure is disposed in a lowermost portion of the cabinet, with the transverse inlet leg of the heat exchanger being selectively disposed lowermost or uppermost to define the two selective arrangements.

15 Claims, 1 Drawing Sheet

HEAT EXCHANGER FOR FURNACE

BACKGROUND OF THE INVENTION

1. Field of the Invention

This invention relates primarily to furnaces and in particular to heat exchangers for use in furnaces.

2. Description of the Background Art

In one form of conventional domestic furnace, air to be heated is passed in heat transfer association with a serpentine heat exchanger. The heat exchanger defines a flow path for hot products of combustion conventionally produced by combustion of fluid fuel, such as fuel oil, gas, etc.

The hot products of combustion, in passing through the heat exchanger, transfer their heat to the air to be heated, conventionally referred to as the room air, and are then exhausted through a suitable flue.

It is desirable, in such furnaces, to maximize the amount of heat transfer from the products of combustion to the room air. Thus, it is conventional to utilize a serpentine heat exchanger for effecting a continuingly increasing temperature of the room air as it flows from an inlet portion of the heat exchanger zone to an outlet portion thereof.

It is further conventional, in the use of such heat exchangers, to heat the room air by a counterflow of the hot products of combustion through the heat exchanger, In certain installations, it is most desirable to effect a uniform distribution of the heat transfer while accepting a somewhat lower overall efficiency therein.

SUMMARY OF THE INVENTION

The present invention comprehends the provision of a heat exchanger for furnaces and the like comprising improved heat transfer means for transferring heat from the products of combustion to the conditioned air, with the direction of relative flow therebetween being selectively in one direction or the other as desired.

The heat transfer means of the invention is arranged to provide substantially similar efficiencies of heat transfer in either relative direction of the air and products of combustion flow while selectively providing improved temperature distribution in the heated air at slightly reduced efficiency in the arrangement where the room air is flowed generally in the same direction as the products of combustion.

In the illustrated embodiment, the improved heat transfer means includes a transverse leg, and at least three legs extending generally longitudinally of the direction of the room air flow in defining a serpentine flow path for the products of combustion.

The invention comprehends the provision of the hot products of combustion from the burner initially to the transverse leg thereof.

The invention comprehends that the flow of the room air may be selectively either upwardly or downwardly.

In the illustrated embodiment, the room air inlet to the heat exchanger is provided at the bottom of the heat exchanger and the invention comprehends the selective inversion of the heat exchanger with the transverse inlet portion of the heat exchanger selectively at the bottom or at the top thereof to provide the desired selective alternative heat transfer arrangements discussed above.

The invention assures that at least one longitudinally extending leg of the heat exchanger conducts the products of combustion in counterflow relationship to the flow of the room air.

More specifically, the invention comprehends the provision of such an improved heat transfer means including means defining a conditioned air flow passage having an inlet end and an outlet end and heat exchanger means in the air flow passage defining a product of combustion flow passage having an inlet portion for receiving the hot products of combustion from the burner means and extending generally transversely to the direction of the air flow through the air flow passage adjacent a selected one of either of the ends thereof. The heat exchanger means further includes at least three portions extending longitudinally of the direction of air flow through the air flow passage and connected in series with the transverse portion to define a serpentine arrangement having a first pass connected to the distal end of the transverse portion to receive the hot combustion products passed therethrough and conduct the received hot combustion products in a direction generally parallel to the air flow, a second pass connected to the first pass to receive the hot products of combustion from the first pass and conduct the received hot combustion products in a reverse direction parallel to the air flow, and a third pass connected to the distal end of the second pass to receive the hot products of combustion passed therethrough and conduct them generally parallel to the direction of the air flow. The heat exchanger further includes outlet means for discharging the products of combustion therefrom as desired.

In the illustrated embodiment, each of the heat exchanger leg portions extends generally rectilinearly.

The heat exchanger means of the present invention is extremely simple and economical of construction, while yet providing the improved selective functioning thereof.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
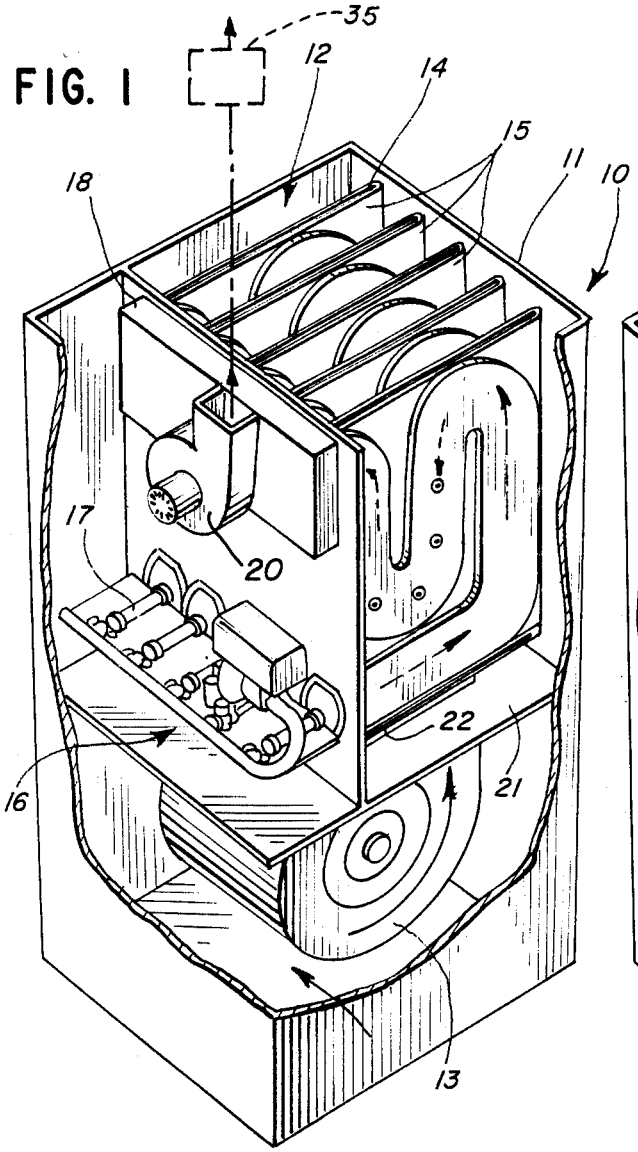
FIG. 1 is a perspective view of a furnace having a heat transfer means embodying the invention, with portions broken away to better illustrate the invention.

In the illustrative embodiment of the invention as disclosed in the drawing, a furnace generally designated 10 includes an outer housing, or cabinet 11. Mounted within the cabinet is a heat exchanger generally designated 12. Air to be conditioned, hereinafter referred to as room air, is delivered to the heat exchanger by a blower 13.

As shown in FIG. 1, the heat exchanger is defined by a plurality of side-by-side heat exchanger elements 14 defining therebetween a plurality of air flow passages 15 for passing air delivered from the blower 13 in heat transfer association with the heat exchanger elements.

Hot products of combustion are flowed through the interior of the heat exchanger elements from a burner means 16 having a plurality of individual burners 17 associated one each with each of the heat exchanger elements 14.

A header manifold 18 receives the products of combustion from the respective heat exchanger elements. The products of combustion are exhausted from the furnace through a discharge flue (not shown) by means of a blower 20.

As shown in FIG. 1, the blower 13 is disposed subjacent a horizontal divider wall 21 so as to deliver the air to be conditioned upwardly through an inlet opening 22 in the divider wall communicating with the heat exchanger flow passages 15. After passing in heat exchange relationship with the heat exchanger elements 14, the heated air is conducted to the space to be heated by suitable duct means (not shown).

The room air may be recirculated through the furnace by suitable return ducts (not shown) to the blower 13.

As indicated briefly above, the invention is concerned with the provision of an improved heat exchanger configuration, permitting the furnace to be selectively utilized to provide maximum efficiency or maximum uniformity in temperature distribution to the air with slightly less than maximum efficiency of heat transfer. The arrangement of the heat exchanger and room air blower, as shown in FIG. 1, provides for maximum uniformity in the temperature distribution of the heated air at a relatively high heat transfer efficiency. In one furnace constructed in accordance with the invention, the heat transfer efficiency was approximately 78.4% (A.F.U.E.).

Figure 3:
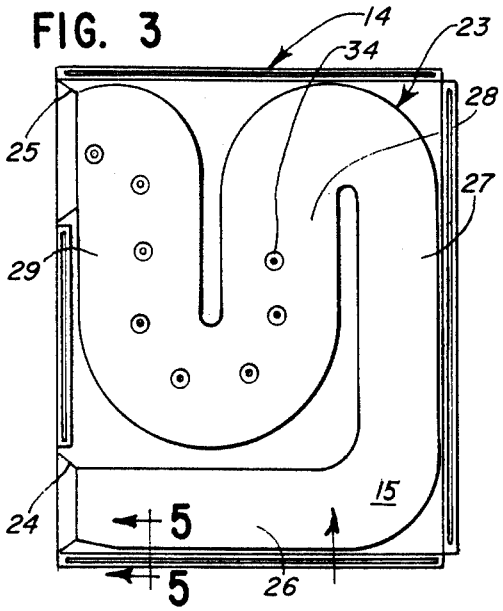
FIG. 3 is a side elevation of the heat exchanger as shown in FIG. 1.
Figure 5:
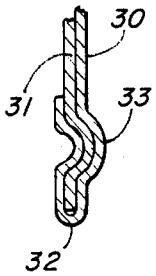
FIG. 5 is a fragmentary enlarged vertical section taken substantially along the line 5—5 of FIG. 3 illustrating one method of forming the heat exchanger from a pair of complementary form plates.

As shown in FIG. 3, the heat exchanger elements 14 define a serpentine products of combustion passage 23 having an inlet 24 and an outlet 25. The hot products of combustion gases received from the respective burners 17 enter the passage 23 through the inlet 24 to flow through a first leg 26 which extends generally horizontally and transversely to the air flow passages 15 defined between the respective heat exchanger elements 14 and the cabinet walls.

As further shown in FIG. 3, the heat exchanger includes at least three additional portions, including a second leg 27, a third leg 28, and a fourth leg 29. Legs 27, 28 and 29 extend generally parallel to each other and, in the direction of the air flow from blower 13 upwardly through the air flow passages 15. After passing successively through heat exchanger leg portions 26, 27, 28, and 29, the products of combustion are exhausted through the outlet 25 to the manifold 18. Thus, the hottest gases received directly from the burner 17 are adjacent the inlet opening 22 to the flow passages 15.

In this arrangement of the furnace, only leg 28 conducts the products of combustion in counterflow to the upwardly flowing room air.

In the illustrated embodiment, each of the leg portions 26, 27, 28, and 29 is substantially rectilinear and, as shown in FIG. 3, the cross-sectional area of leg portions 28 and 29 is less than the cross-sectional area of leg portions 26 and 27.

The heat exchanger elements may be formed by any suitable conventional means. In the illustrated embodiment, the elements are formed by preforming a pair of individual plates 30 and 31 to define opposed recesses having the serpentine configuration illustrated in FIG. 3, with the edges of plates 30 and 31 secured together in sealed relationship by a turned end portion 32 of the plate 30 and with the edge portions of the plate suitably crimped as at 33.

Cross-connecting dimples 34 may be provided between the plates for rigidifying the assembly of the elements and providing further heat transfer between the hot products of combustion flowing through legs 28 and 29 and the plate portions exteriorly contacted by the room air.

As indicated briefly above, the heat transfer means of the present invention is adapted for a reverse arrangement of the heat exchange relative to the flow of the room air.

As indicated briefly above, the heat transfer means of the present invention is adapted for a reverse arrangement of the heat exchange relative to the flow of the room air. Such a reverse arrangement is illustrated in the furnace construction generally designated 110 of FIG. 2, wherein the heat exchanger generally designated 112 is inverted relative to the heat exchanger 12 of furnace 10. Thus, the inlet transversely extending leg portion 126 of heat exchanger 112 is disposed in the upper portion of the heat exchanger, but with the longitudinally arranged legs 127 disposed lowermost so as to be first contacted by the room air delivered through the inlet 122.

Figure 2:
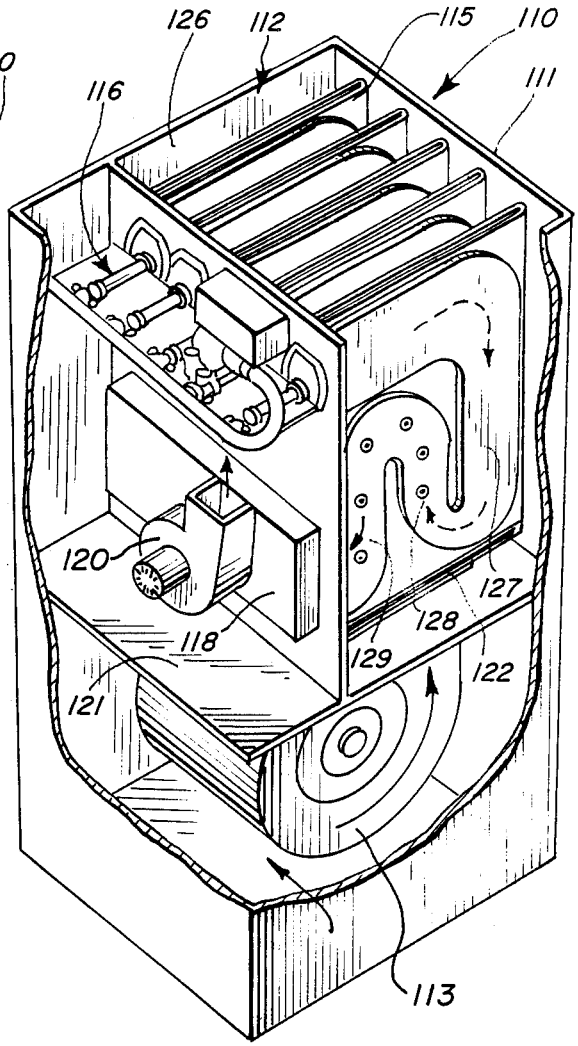
FIG. 2 is a perspective view generally similar to that of FIG. 1 but of a modified arrangement of the furnace wherein the products of combustion are flowed generally in a counterflow relationship with the air to be heated.

As further shown in FIG. 2, in the inverted arrangement of furnace 110, the burner means 116 is disposed at the top of the cabinet 111, and the exhaust manifold 118 is disposed adjacent the divider wall 121.

In the arrangement of furnace 110, the hot products of combustion enter the heat exchanger through the inlet 124 at the top of the heat exchanger, and the products of combustion are discharged therefrom through the lowermost outlet 125. Thus, this heat exchanger arrangement provides a predominantly counterflow heat transfer association between the products of combustion and the room air as the hottest products of combustion are in the transverse leg 126 at the top of the cabinet, and the coolest portion of the products of combustion in each of legs 127 and 129 is at the lowermost end thereof first contacted by the room air as it enters the air flow passages 115 from the divider wall opening 122. The intermediate vertical leg 128 conducts the products of combustion in the direction of the air flow and, thus, provides for some improved uniformity of temperature distribution also in the arrangement of FIGS. 2 and 4.

Figure 4:
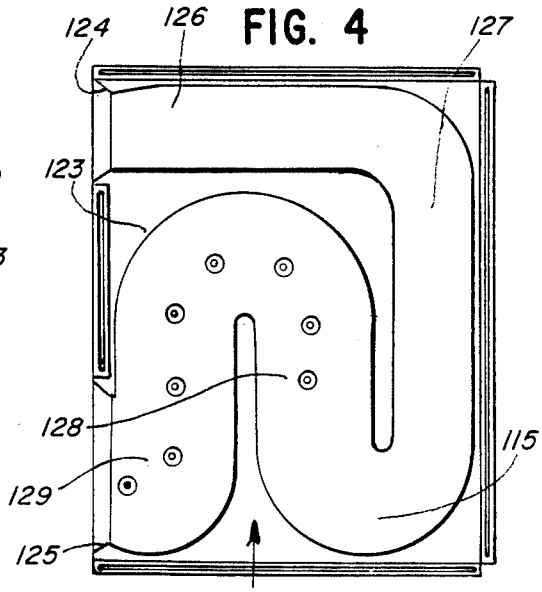
FIG. 4 is a side elevation of the heat exchanger as shown in FIG. 2.

In a furnace constructed in accordance with the embodiment of FIGS. 2 and 4, the heat transfer efficiency was found to be approximately 81.4% (A.F.U.E.).

Where maximum efficiency in heat transfer is desired, a secondary heat exchanger, illustratively shown at 35 in FIG. 1, may be employed with either of the illustrated furnace embodiments.

Flow of air through the products of combustion passages of the heat exchanger during the furnace-off periods is effectively precluded by means of the blower 20, which may be caused to operate only during the heat transfer operation.

Portions of furnace 110 which are similar to corresponding portions of furnace 10 are identified by similar reference numerals but 100 higher. Except as discussed above, furnace 110 functions in the same manner as furnace 10.

The heat transfer means of the present invention is extremely simple and economical while yet permitting the use thereof selectively to provide either a maximum heat transfer efficiency or maximum temperature distribution of the heated air with slightly reduced but generally similar high heat transfer efficiency.

The foregoing disclosure of specific embodiments is illustrative of the broad inventive concepts comprehended by the invention.

I claim:

1. For use in a furnace having burner means for providing hot products of combustion, and air flow means for circulating conditioned air, an improved heat transfer means for transferring heat from the products of combustion to the conditioned air, comprising:

means defining a conditioned air flow passage having an inlet end and an outlet end; and heat exchanger means in said air flow passage defining a products of combustion flow passage, said heat exchanger means having a. a substantially linear inlet portion for receiving hot products of combustion directly from the burner means, said inlet portion extending transversely to the direction of air flow through said air flow passage adjacent a selected one of either of said ends thereof, b. at least three further substantially linear portions extending longitudinally of the direction of air flow through said air flow passage, said further portions being connected in series to define a serpentine arrangement having a first pass connected to said transverse portion to receive the hot combustion products passed therethrough and conduct the received hot combustion products in a direction generally perpendicularly to and away from said transverse portion toward the other of said ends of said air flow passage, a second pass connected to said first pass to receive the hot products of combustion passed therethrough and conduct the received hot combustion products in a direction generally perpendicularly to and toward said transverse portion, and a third pass connected to said second pass to receive the hot products of combustion passed therethrough and conduct the received hot products of combustion in a direction generally perpendicularly to and away from said transverse portion toward the other of said ends of said air flow passage, and c. outlet means directly connected to said third pass for discharging the products of combustion passed through the heat exchanger means.

2. The furnace structure of claim 1 wherein said further portions of the heat exchanger means comprise parallel rectilinear portions.

3. The furnace structure of claim 1 wherein said outlet means of the heat exchanger means is disposed adjacent said other of the ends of said air flow passage.

4. The furnace structure of claim 1 wherein said further portions of the heat exchanger means extend to adjacent said other of the ends of said air flow passage.

5. The furnace structure of claim 1 wherein said one of said ends of the air flow passage comprises said inlet end and the furnace structure further includes a secondary heat exchanger connected to said outlet means.

6. The furnace structure of claim 1 wherein said products of combustion flow passage in said third pass has a transverse cross-sectional area less than the transverse cross-sectional area thereof in said inlet portion of the heat exchanger means.

7. The furnace structure of claim 1 wherein said products of combustion flow passage in said second and third passes has a transverse cross-sectional area less than the transverse cross-sectional area thereof in said inlet portion of the heat exchanger means.

8. The furnace structure of claim 1 wherein said products of combustion flow passage in said second and third passes has a transverse cross-sectional area less than the transverse cross-sectional area thereof in said first pass and said inlet portion of the heat exchanger means.

9. For use in a furnace having burner means for providing hot products of combustion, and forced air flow means for circulating conditioned air, an improved heat transfer means for transferring heat from the products of combustion to the conditioned air comprising:

means for defining a conditioned air flow passage having an inlet end and an outlet end, said forced air flow means forcibly delivering air to said inlet end; and heat exchanger means in said air flow passage defining a products of combustion flow passage, said heat exchanger means having a. a substantially linear inlet portion for receiving hot products of combustion directly from the burner means, said inlet portion extending transversely to the direction of air flow through said air flow passage adjacent a selected one of either of said ends thereof, b. at least three further substantially linear portions extending longitudinally of the direction of air flow through said air flow passage, said further portions being connected in series to define a serpentine arrangement having a first pass connected to said transverse portion to receive the hot combustion products passed therethrough and conduct the received hot combustion products in a direction generally perpendicularly to and away from said transverse portion toward the other of said ends of said air flow passage, a second pass connected to said first pass to receive the hot products of combustion passed therethrough and conduct the received hot combustion products in a direction generally perpendicularly to and toward said transverse portion, and a third pass connected to said second pass to receive the hot products of combustion passed therethrough and conduct the received hot products of combustion in a direction generally perpendicularly to and away from said transverse portion toward the other of said ends of said air flow passage, and c. outlet means directly connected to said third pass for discharging the products of combustion passed through the heat exchanger means.

10. The furnace structure of claim 9 wherein said inlet end of the air flow passage is spaced below said outlet end.

11. The furnace structure of claim 9 wherein said inlet end of the air flow passage is spaced below said outlet end and said forced air flow means is disposed subjacent said inlet end.

12. The furnace structure of claim 9 further including means for forcibly flowing the hot products of combustion through said products of combustion flow passage.

13. An improved heat exchanger for use in a furnace having burner means having forced flow means for providing hot products of combustion, forced air flow means for circulating conditioned air, and means defining a conditioned air flow passage having an inlet end and an outlet end said improved heat exchanger comprising a. a substantially linear inlet portion for receiving hot products of combustion directly from the burner means, said inlet portion extending transversely to the direction of air flow through said air flow passage adjacent a selected one of either of said ends thereof, b. three further substantially portions extending longitudinally of the direction of air flow through said air flow passage, said further portions being connected in series to define a serpentine arrangement having a first pass connected to said transverse portion to receive the hot combustion products passed therethrough and conduct the received hot combustion products in a direction generally perpendicularly to and away from said transverse portion toward the other of said ends of said air flow passage, a second pass connected to said first pass to receive the hot products of combustion passed therethrough and conduct the received hot combustion products in a direction generally perpendicularly to and toward said transverse portion, and a third pass connected to said second pass to receive the hot products of combustion passed therethrough and conduct the received hot products of combustion in a direction generally perpendicularly to and away from said transverse portion toward the other of said ends of said air flow passage, and c. outlet means directly connected to said third pass for discharging the products of combustion passed through the heat exchanger means from said third pass.

14. The furnace structure of claim 13 wherein said inlet portion of the heat exchanger means is disposed adjacent said inlet end of said air flow passage.

15. The furnace structure of claim 13 wherein said inlet portion of the heat exchanger means is disposed adjacent said outlet end of said air flow passage.

* * * * *